US007463206B1

(12) United States Patent
Kyhle

(10) Patent No.: US 7,463,206 B1
(45) Date of Patent: Dec. 9, 2008

(54) ANTENNA

(75) Inventor: Anders Kyhle, Lund (SE)

(73) Assignee: Naval Electronics AB, Malmo (SE)

( * ) Notice: Subject to any disclaimer, the term of this patent is extended or adjusted under 35 U.S.C. 154(b) by 0 days.

(21) Appl. No.: 11/811,579

(22) Filed: Jun. 11, 2007

(51) Int. Cl.
*H01Q 3/00* (2006.01)

(52) U.S. Cl. ..... 343/766; 343/765; 343/781; 343/882

(58) Field of Classification Search ..... 343/757, 343/765, 766, 781, 853, 878, 882
See application file for complete search history.

(56) References Cited

U.S. PATENT DOCUMENTS

| | | | | |
|---|---|---|---|---|
| 6,204,823 | B1 * | 3/2001 | Spano et al. | 343/766 |
| 7,173,571 | B2 * | 2/2007 | Webb et al. | 343/766 |
| 7,256,749 | B2 * | 8/2007 | DeSargant et al. | 343/781 CA |
| 7,301,505 | B2 * | 11/2007 | King | 343/757 |

* cited by examiner

*Primary Examiner*—Lincoln Donovan
*Assistant Examiner*—Chuc Tran
(74) *Attorney, Agent, or Firm*—Tarolli, Sundheim, Covell & Tummino LLP

(57) ABSTRACT

A self-stabilizing antenna is pivotable about an axis of elevation, a cross-level axis and an azimuth axis. The antenna comprises an antenna member (1) for transfer of signals between said antenna member and a satellite, and a frame member (6) on which the antenna member (1) is mounted for mounting thereof on said movable support. The frame member (6) includes mounting members (7, 8 and 9) permitting pivotal movement of the antenna member about said axes. The antenna further comprises driving units (12, 14) for pivotal movement of the antenna member (1) about said axes, electronic units (21, 22) for sensing and controlling the pivotal movements of the antenna member (1) and for the transfer of signals between the antenna member and a satellite, a signal transformer unit (5), a signal amplifier unit (23), a signal transfer unit (30) and a gyroscope unit (24). For providing an antenna which is kept still during transmission and/or reception of signals from a satellite, said units (5, 12, 14, 21, 22, 23, 24 and 30) are provided such that more than 50% of the total mass of the antenna is concentrated to the antenna member (1) and/or to the frame member (6) in direct connection with the antenna member (FIG. 1).

16 Claims, 5 Drawing Sheets

1
2
11
7
10
8
25
28
4
6
27
29
28
19
20
16
17
18
9
21
22
24
5
30
3
8
14
15
26
27

A
B
1
2
3
6
7
8
11
13
14
15
17
21
24
26
28
29
30
31
32
33
34
35

ANTENNA

FIELD OF THE INVENTION

The present invention relates to a self-stabilizing antenna which is pivotable about an axis of elevation, a cross-level axis and an azimuth axis and which is adapted for mounting on a movable support, wherein the antenna comprises an antenna member for transfer of signals between said antenna member and a satellite, and a frame member on which the antenna member is mounted, for mounting said antenna member on said movable support, said frame member including mounting members permitting pivotal movement of the antenna member about said axes, and wherein the antenna further comprises at least one or more driving units for pivotal movement of the antenna member about said axes, one or more electronic units for sensing and controlling the pivotal movements of the antenna member and for the transfer of signals between the antenna member and a satellite, a unit for, inter alia, transforming the signals from the satellite, a unit for amplifying the signals from the satellite, a unit for transferring the signals from the satellite from said signal transformer unit to said signal amplifier unit, and a gyroscope unit.

BACKGROUND OF THE INVENTION

A problem at such an antenna is to keep the antenna still also when the support, preferably a ship, on which the antenna is mounted, is moving in heavy sea.

Two principal conditions for succeeding therewith are on one hand that the friction in bearings and other details for interconnecting the various components and units of the antenna, e.g. cables, is minimal, on the other hand that the mass of the antenna is as large as possible.

Minimal friction is obtained by means of suitable bearings. Low start friction is also important, since many times only relatively small and slow movements are involved.

Cables interconnecting the various components and units electrically, are chosen with regard to mechanical properties for attaining the least torsional resistance alternatively flexural resistance. The attachments for the cables and the connection paths therefor between the various components and units highly affect the movability of the antenna. In order to attain the least possible torsional and flexural resistance, it is possible to use helical cables or large loops of cable which distribute flexural and torsional forces over long sections of the cables.

The requirement that the antenna shall have a large mass is determined in principal by how much the antenna is allowed to weigh, where it will be situated and the stress the attachment therefor can/shall manage. However, for productive and functional reasons it is obviously an advantage if the weight of the antenna is kept low and the size thereof is small.

SUMMARY OF THE INVENTION

In order to, based on such conditions, provide an antenna which is kept still as much as possible during transmission and/or reception of signals from a satellite, it is desired according to the invention that as much as possible of the available mass of the antenna is found in connection with the antenna member.

Therefore, the invention is characterized by the fact that said units forming part of the antenna are provided such that more than 50% of the total mass of the antenna is concentrated to the antenna member and/or to the frame member in direct connection with the antenna member.

According to a preferred embodiment of the invention, this means that at least said one or more electronic units and said signal amplifier unit are mounted on the antenna member and/or on the frame member in direct connection with the antenna member.

The weight the antenna member has attained according to the invention, counter-acts movements of the antenna member, which is important particularly during transfer of signals between the antenna member and a satellite. Thus, in other words, all "heavy" components and units of the antenna are as far as possible mounted on the antenna member or as close as possible thereto in order to thereby make the most use of the mass and get the least influence from friction and rigidness in e.g. bearings and cables.

The abovementioned and other characterizing features of the invention will be further described below with reference to the accompanying drawings.

DETAILED DESCRIPTION OF A PREFERRED EMBODIMENT OF THE INVENTION

Figure 1:
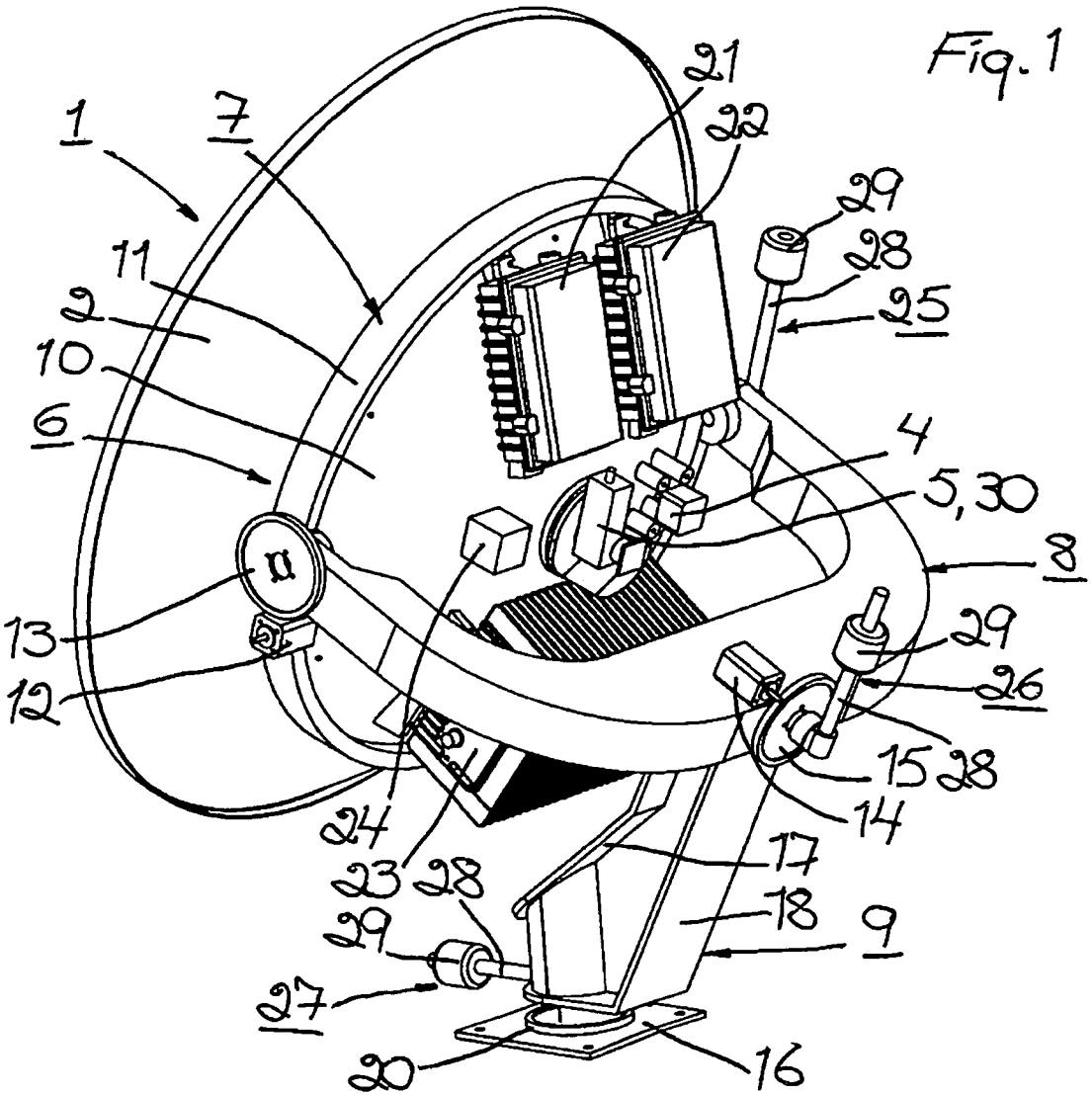
FIG. 1 is a schematic perspective view of a preferred embodiment of the antenna according to the invention.
Figure 2:
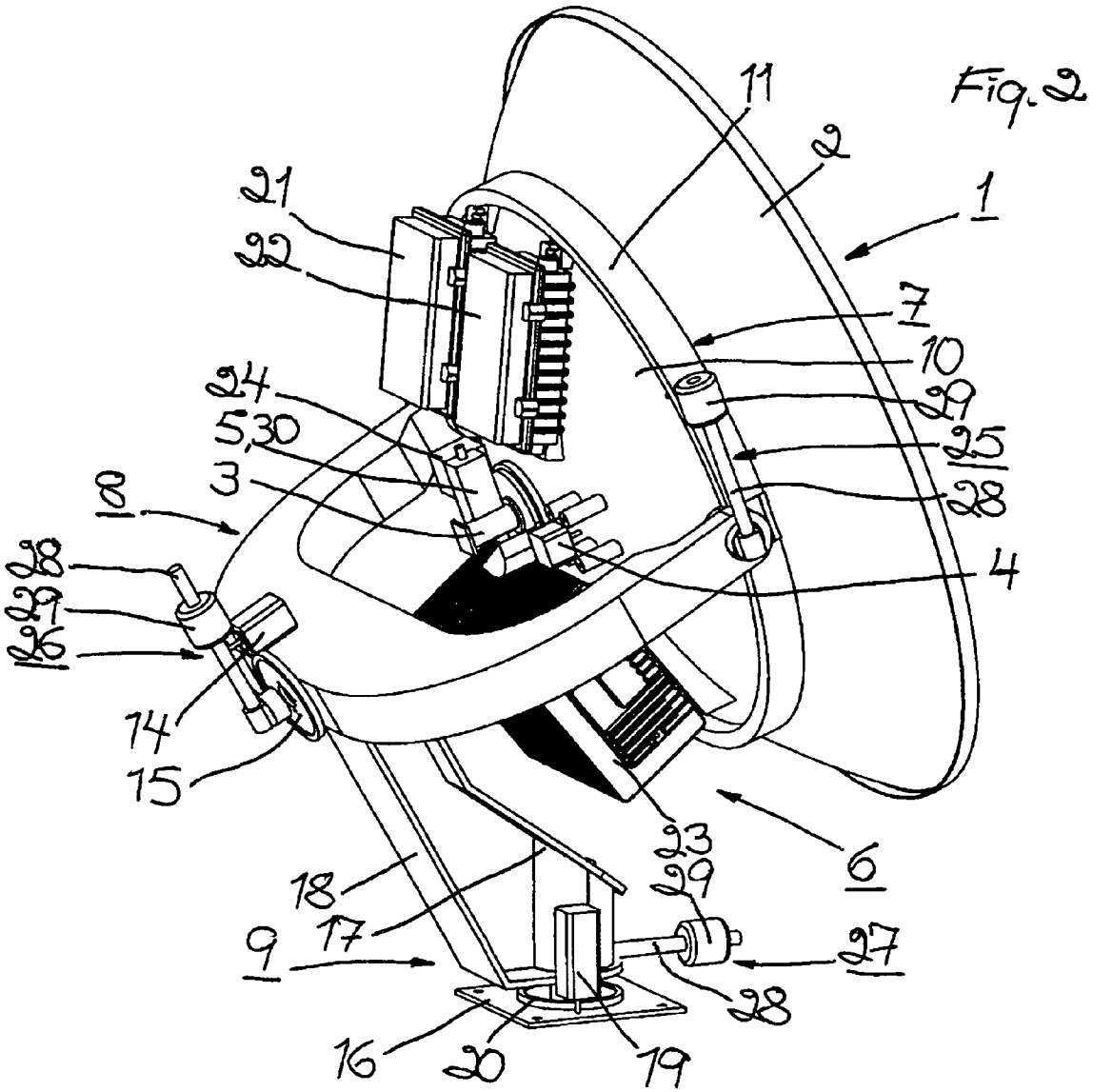
FIG. 2 is another schematic perspective view of the antenna of FIG. 1.
Figure 3:
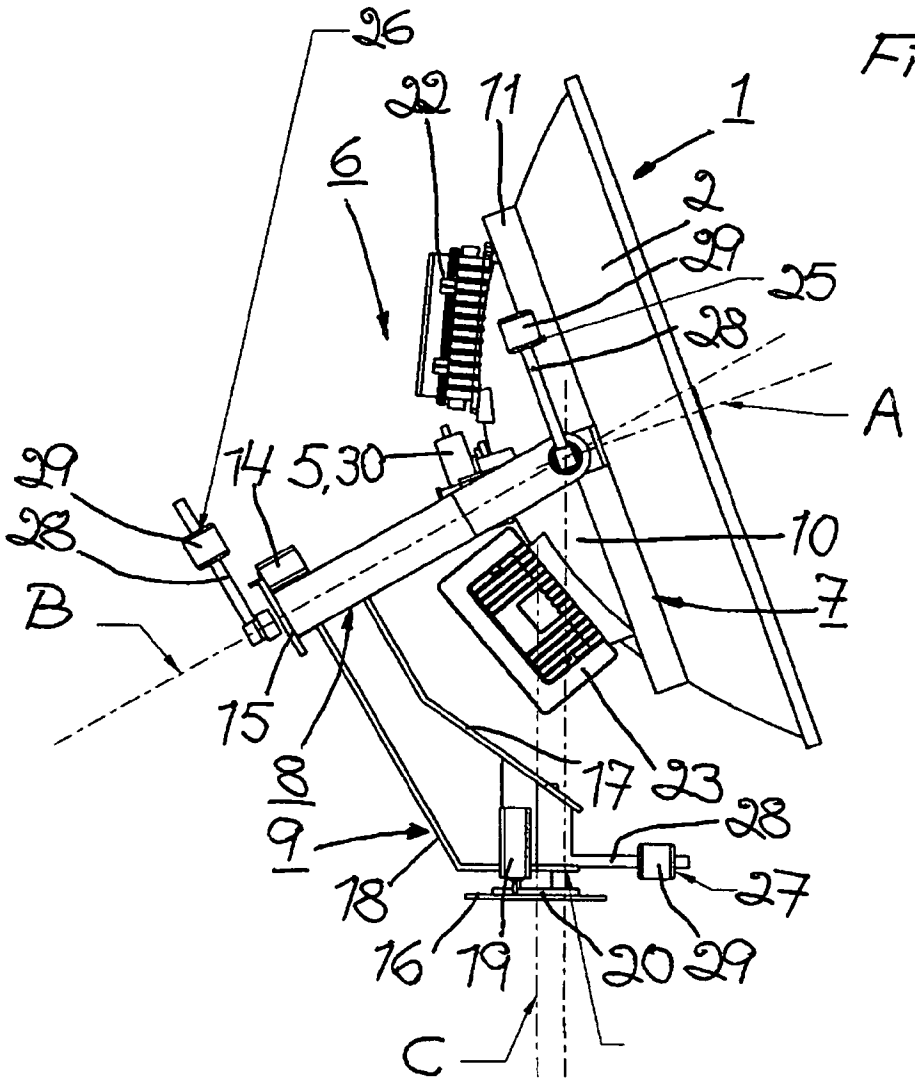
FIG. 3 is a schematic side view of the antenna of FIG. 1.

Thus, FIGS. 1 and 2 illustrate a self-stabilizing antenna which is adapted for mounting on a movable support (not shown), preferably a ship. The antenna is pivotable about three axes that extend at an angle relative to each other, namely an axis of elevation A, a cross-level axis B and an azimuth axis C, i.e. the antenna is pivotable in space, in order to maintain the set orientation towards a satellite in e.g. heavy sea.

Figure 4:
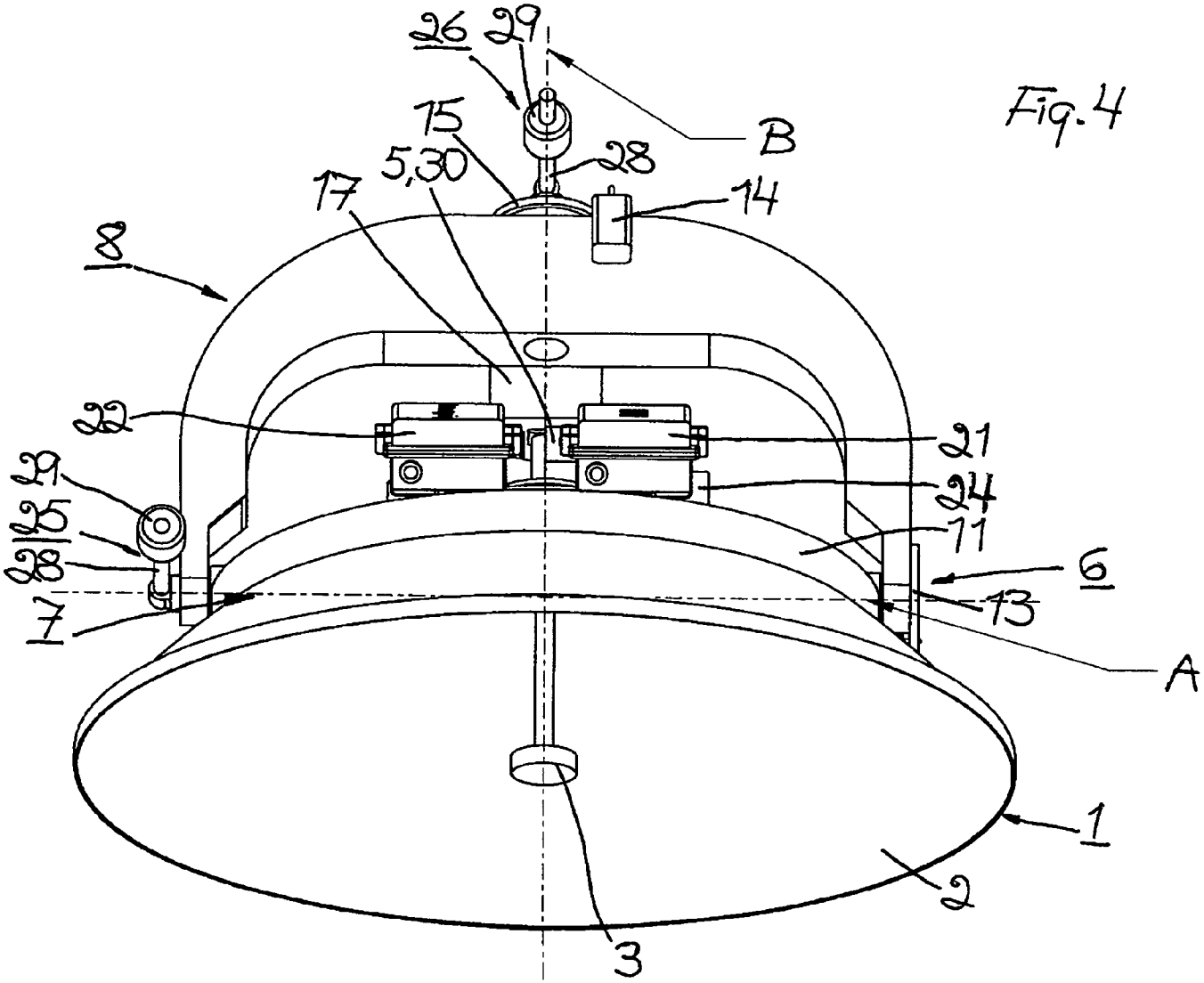
FIG. 4 is a schematic top view of the antenna of FIG. 1.
Figure 5:
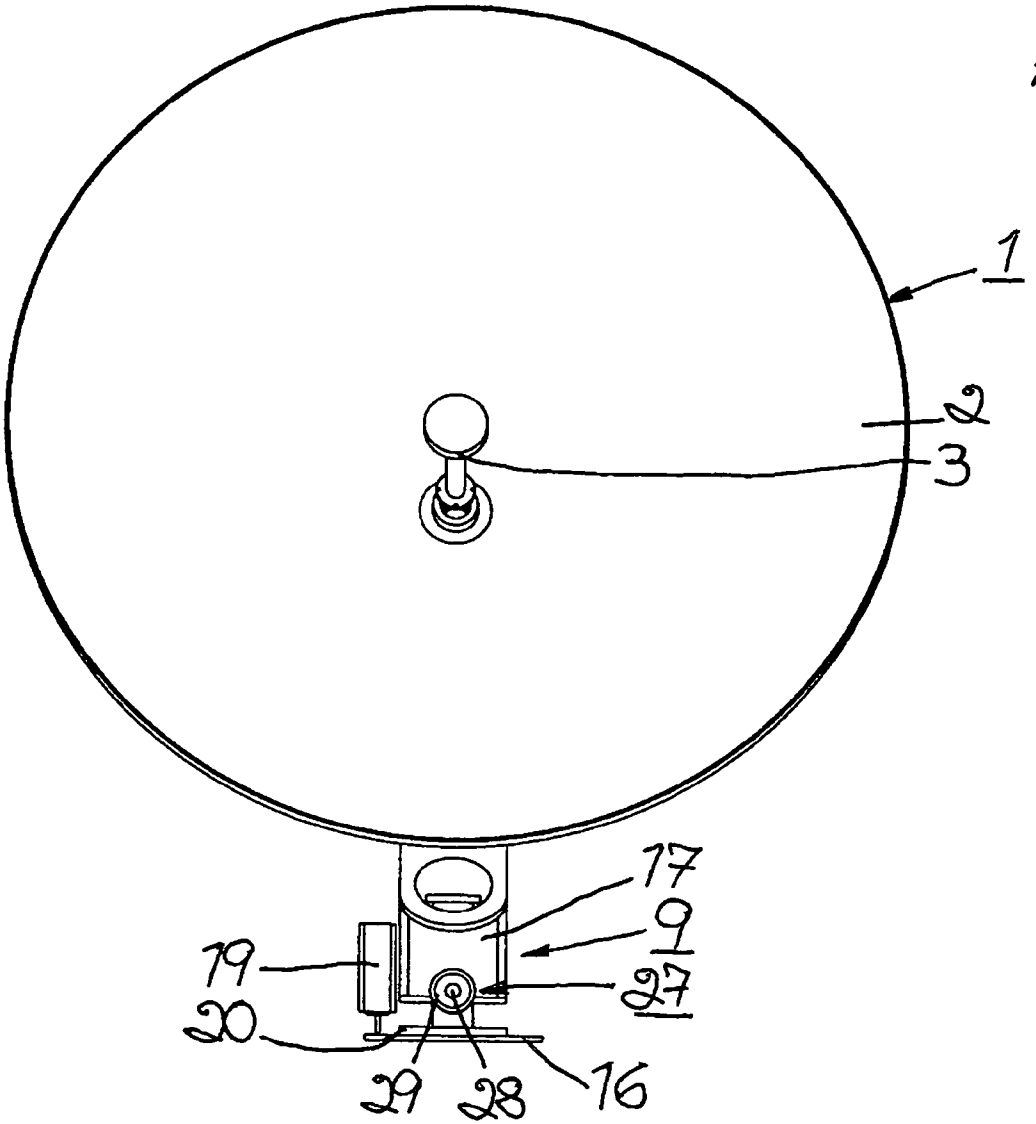
FIG. 5 is a schematic front view of the antenna of FIG. 1.

The antenna comprises an antenna member 1, in the illustrated embodiment a parabolic reflector 2 with a horn 3 (FIGS. 4 and 5) for transfer of signals between the antenna member and a satellite. The horn 3 is operable, i.e. rotatable by means of a drive unit 4, an electric motor, for correct polarization of the signals. To the horn 3 there is connected a signal transformer unit in the form of a so called LNB (Low Noise Block)-unit 5 which transforms the signals from a satellite to a lower and more manageable frequency and amplifies said signals to a suitable level. Said LNB-unit 5 is also rotated by the polarization motor 4.

The antenna member 1 is mounted on a frame member 6 of the antenna. The frame member 6 is used for mounting the antenna member 1 on the movable support. The frame member 6 includes mounting members for permitting pivotal movement of the antenna member 1 about said axes A, B, C. Since said axes A, B, C are three in number, the frame member 6 includes, in the illustrated embodiment, three mounting members 7, 8 and 9, i.e. one mounting member for each axis.

The antenna member 1 is with the rear side attached to a first mounting member 7 of the frame member 6. This first mounting member 7 consists of a plate, in the illustrated embodiment a round plate 10, surrounded by a flange portion 11. The antenna member 1 is attached to the plate 10, preferably screwed onto said plate, and through the flange portion 11 journalled on a second mounting member 8 for pivotal movement of the antenna member about the axis of elevation A. A drive unit 12, preferably a servo motor of a suitable type, is in the illustrated embodiment located at one of two opposing bearing points for the flange portion 11 on the second mounting member 8 for pivoting movement of the first mounting member 7, with the antenna member 1, about the axis of elevation A. The drive unit 12 may thereby be mounted on the flange portion 11 and with an output shaft cooperate with a gear wheel 13 or other type of transmission which is mounted on the second mounting member 8 such that said drive unit and along therewith, said first mounting member 7 and said antenna member 1, move around said gear wheel.

The second mounting member 8 of the frame member 6 is in the illustrated embodiment shaped as a yoke and the arms of said yoke are connected to the flange portion 11 of the first mounting member 7 at said opposing bearing points.

The antenna member 1 is through the second mounting member 8 of the frame member 6 journalled on a third mounting member 9 of said frame member for pivotal movement about the cross-level axis B. A drive unit 14 of preferably the same type as drive unit 12 is in the illustrated embodiment provided to bring about this pivotal movement. Suitably, the drive unit 14 may thereby be mounted on the second mounting member 8 and the output shaft thereof cooperate with a gear wheel 15 or similar which is mounted on the third mounting member 9 such that said drive unit and along therewith said second mounting member and thus, the first mounting member 7 with the antenna member 1 as well, move around said gear wheel.

Through the third mounting member 9 of the frame member 6, the antenna member 1 is journalled on the movable support for pivotal movement about the azimuth axis C. In the illustrated embodiment, the third mounting member 9 includes a mounting plate 16 on which holder plates 17 and 18 for the second mounting member 8 of the frame member 6 are located for pivotal movement of said second mounting member about the cross-level axis B. A drive unit 19 of preferably the same type as the drive units 12 and 14 is provided to bring about pivotal movement about the azimuth axis C of the holder plates 17, 18, and thereby of the antenna member 1 through the first and second mounting members 7, 8, relative to the mounting plate 16. The drive unit 19 may thereby be mounted on the holder plates 17, 18 and with the output shaft thereof cooperate with a gear wheel 20 or similar on the mounting plate 16 such that the entire antenna moves around said gear wheel.

Beyond the abovementioned antenna and frame members 1, 6 and the members, components and units etc. forming part thereof, the antenna comprises one or more electronic units, in the illustrated embodiment two electronic units 21 and 22, for sensing and controlling the pivotal movements of the antenna member 1 and for the transfer of signals between the antenna member and a satellite. These two electronic units are in the illustrated embodiment formed by a central processing unit (CPU) 21 and a motor control unit 22 which are both relatively large and heavy. The construction of the electronic units 21, 22, i.e. here the CPU 21 and the motor control unit 22, for performing said and eventual other functions does not form part of the present invention and is therefore not described in detail here.

In the illustrated embodiment, the antenna further comprises a unit 23 for amplifying the signals from the satellite, said signal amplifier unit also being relatively large and heavy, a unit 30 for transferring the signals from the satellite from said LNB-unit 5 to said signal amplifier unit 23, e.g. a so called OMT (Orthogonal Mode Transducer)-unit, and a gyroscope unit 24. Said OMT-unit 30 is located very close to the LNB-unit 5 and rotates therewith.

In order to see to, as initially mentioned, that the antenna member 1 does not move during transfer of signals, but counteract movements by giving the antenna member a large mass such that said antenna member becomes sluggish and difficult to move out of a set position, the units forming part of the antenna, i.e. in the embodiment described above, the LNB-unit 5, the drive units 4, 12, 14, 19, the CPU 21, the motor control unit 22, the signal amplifier unit 23, the OMT-unit 30 and the gyroscope unit 24, are according to the invention provided such that more than 50% of the total mass of the antenna is concentrated to the antenna member 1 and/or to the frame member 6 in direct connection with the antenna member.

In the embodiment illustrated in the drawings, the CPU 21, the motor control unit 22 and the signal amplifier unit 23 are consequently mounted on the antenna member 1 and/or on the frame member 6 in direct connection with the antenna member, as are the drive units 4, 12, the LNB-unit 5 and the OMT-unit 30. In more detail, for the purpose of the invention, at least the CPU 21, the motor control unit 22 and the signal amplifier unit 23 are mounted on the rear side of the antenna member 1 and/or on the frame member 6 at the rear side of the antenna member, preferably on the first mounting member 7 of the frame member and thereby most preferably on the plate 10 of said first mounting member. The CPU 21, the motor control unit 22 and the signal amplifier unit 23 are mounted on the plate 10 preferably such that the weight or mass of these units is uniformly distributed on both sides of the axis of elevation A of the antenna member 1.

The gyroscope unit 24 is also found on the plate 10 of the first mounting member 7, while, as already mentioned, the drive unit 12 is found on the flange portion 11 of the first mounting member.

Those members, components, drive units etc. which in an application of the invention can not sit on the antenna member 1 or on the first mounting member 7 of the frame member 6, are located in the best possible way in connection with said antenna member on the subsequent, separately movable members, i.e. primarily on the second mounting member 8 and secondly on the third mounting member 9.

In order to get an optimum distribution of the mass as defined above and simultaneously keeping the total weight of the antenna within the desired interval, at least all members except the antenna member 1 and the first mounting member 7 of the frame member 6 are made as light as possible, e.g. of aluminum since aluminum provides for strength and rigidness in combination with low weight. If the parabolic reflector 2 of the antenna member 1 is made of plate sheet, it can not be expected to carry all heavy components which then have to be mounted preferably on the first mounting member 7 of the frame member 6. This first mounting member 7 should then not be made of light metal. All other components and units are also made in an optimum manner in order to arrive at the defined object of the invention.

The theoretically optimum antenna with regard to its motion pattern and balance, has a common pivoting point for all three at an angle relative to each other extending axes A, B, C. However, such an embodiment where all these axes A, B, C intersect each other in one point, can not be arrived at with a construction according to the present invention with more than 50% of the total mass of the antenna concentrated to the antenna member 1 and/or to the frame member 6 in direct connection with the antenna member. In other words, the axes A, B, C must be displaced relative to each other and balancing thereabout be carried through separately.

For balancing, the first, second and third mounting members 7, 8, 9 of the frame member 6 each includes a balancing weight 25, 26 and 27 respectively. By means of these balancing weights 25, 26, 27, said mounting members 7, 8, 9 are balanced about the axis of elevation A, the cross-level axis B and the azimuth axis C respectively, such that said mounting members remain in each position in which they are set. Each balancing weight 25, 26, 27 consists, in the illustrated embodiment, of a rod 28 with a weight 29 which is displaceable along the rod, but may be of any other suitable construction. The parabolic reflector 2 of the antenna member 1 may further include one or more balancing weights (not illustrated) which are rigidly mounted on the rear side of said reflector.

As mentioned above, the mounting members 7, 8, 9 are balanced separately, starting with the first mounting member 7 with the antenna member 1. Balancing is carried through statically (find position of equilibrium) such that the centre of gravity is located on its pivot axis (axis of elevation A). Thus, a position is found where the first mounting member 7 with the antenna member 1 can be set in any optional angle of elevation without said members swinging back to another position.

Then, the second mounting member 8 is balanced in a similar way with regard to the cross-level axis B by obtaining a state of equilibrium by means of the balancing weight 26 thereon, such that any optional angle can be chosen without the mounting member swinging to any side.

Finally, the third mounting member 9 is balanced about the azimuth axis C in a similar manner by means of the balancing weight 27. To this end however, it is required that the entire antenna is turned such that the azimuth axis C is directed horizontally for using the gravity to find the position of equilibrium, i.e. to see which member is swinging downwards by means of the gravity and compensate with the balancing weight in order to find the position of equilibrium.

It is obvious to a skilled person that the present invention can be modified and altered within the scope of the subsequent claims without departing from the idea and purpose of the invention. Thus, beyond what is defined above, the various members, components and units of different types of the antenna may vary in construction in view of their function and so may e.g. the number of electronic units and other components based on the application. It is e.g. possible to use one and the same drive unit for pivotal movement of the antenna member about all three at an angle extending axes.

The invention claimed is:

1. A self-stabilizing antenna which is pivotable about an axis of elevation (A), a cross-level axis (B) and an azimuth axis (C) and which is adapted for mounting on a movable support, wherein the antenna comprises:

an antenna member (1) for transfer of signals between said antenna member and a satellite, and a frame member (6) on which the antenna member (1) is mounted, for mounting said antenna member on said movable support, said frame member including mounting members (7, 8 and 9) permitting pivotal movement of the antenna member about said axes (A, B, C), and wherein the antenna further comprises at least one or more driving units (12, 14 and 19) for pivotal movement of the antenna member (1) about said axes (A, B, C), one or more electronic units (21, 22) for sensing and controlling the pivotal movements of the antenna member (1) and for the transfer of signals between the antenna member and a satellite, a unit (5) for, inter alia, transforming the signals from the satellite, a unit (23) for amplifying the signals from the satellite, a unit (30) for transferring the signals from the satellite from said signal transformer unit (5) to said signal amplifier unit (23), and a gyroscope unit (24), wherein the units (5, 12, 14, 19, 21, 22, 23, 24 and 30) forming part of the antenna are provided such that more than 50% of the total mass of the antenna is concentrated to the antenna member (1) and/or to the frame member (6) in direct connection with the antenna member.

2. The antenna according to claim 1, wherein one or more electronic units (21, 22) and said signal amplifier unit (23) are mounted on the antenna member (1) and/or on the frame member (6) in direct connection with the antenna member.

3. The antenna according to claim 2, wherein one or more electronic units (21, 22) and said signal amplifier unit (23) are mounted on the rear side of the antenna member (1) and/or on the frame member (6) at the rear side of the antenna member.

4. The antenna according to claim 1, wherein the frame member (6) includes a first mounting member (7) which is located on the rear side of the antenna member (1) and that at least said one or more electronic units (21, 22) and said signal amplifier unit (23) are mounted on said first mounting member.

5. The antenna according to claim 4, wherein the first mounting member (7) consists of a plate (10) which is surrounded by a flange portion (11), whereby the antenna member (1) is connected to the plate and through the flange portion journalled on a second mounting member (8) of the frame member (6) for pivotal movement about the axis of elevation (A).

6. The antenna according to claim 5, wherein one or more electronic units (21, 22) and said signal amplifier unit (23) are mounted on the plate (10) of the first mounting member (7) of the frame member (6) such that the mass of said units is uniformly distributed on both sides of the axis of elevation (A).

7. The antenna according to claim 5, wherein the second mounting member (8) of the frame member (6) is formed as a yoke and through the arms of the yoke connected to the flange portion (11) of the first mounting member (7) of the frame member at two opposing points thereon for pivotal movement of said first mounting member with the antenna member (1) about the axis of elevation (A).

8. The antenna according to claim 5, wherein the antenna member (1) is through said second mounting member (8) of the frame member (6) journalled on a third mounting member (9) of the frame member for pivotal movement about the cross-level axis (B).

9. The antenna according to claim 8, wherein the antenna member (1) is through said third mounting member (9) journalled on the movable support for pivotal movement about the azimuth axis (C).

10. The antenna according to claim 8, wherein the third mounting member (9) of the frame member (6) includes a mounting plate (16) on which holder plates (17 and 18) for the second mounting member (8) of the frame member are located for pivotal movement of said second mounting member about the cross-level axis (B).

11. The antenna according to claim 1, wherein a drive unit (12, 14 and 19 respectively) for pivotal movement of the antenna member (1) about said axes (A, B, C) is provided on each mounting member (7, 8 and 9 respectively).

12. The antenna according to claim 1, wherein the mounting members (7, 8, 9) of the frame member (6) each include a balancing weight (25, 26 and 27 respectively) for balancing said members about said axes (A, B and C respectively) such that they remain in each position in which they are set.

13. The antenna according to claim 4, wherein the units (12, 14, 19, 21, 22, 23, 24) forming part of the antenna which are not provided on the antenna member (1) and/or on the first mounting member (7) of the frame member (6), are provided primarily on the closest subsequent, separately movable mounting member (8) and secondly on the thereafter following, separately movable mounting member (9).

14. The antenna according to claim 1, wherein the members (1, 6, 7, 8 and 9) which beyond said units (5, 12, 14, 19, 21, 22, 23, 24 and 30) form part of the antenna are constructed such that they contribute to that more than 50% of the total mass of the antenna is concentrated to the antenna member (1) and/or to the frame member (6) in direct connection with the antenna member.

15. A self-stabilizing antenna which is pivotable about an axis of elevation (A), a cross-level axis (B) and an azimuth axis (C) and which is adapted for mounting on a movable support, wherein the antenna comprises:

an antenna member (1) for transfer of signals between said antenna member and a satellite, and a frame member (6) on which the antenna member (1) is mounted, for mounting said antenna member on said movable support, said frame member including mounting members (7, 8 and 9) permitting pivotal movement of the antenna member about said axes (A, B, C), and wherein the antenna further comprises at least one or more driving units (12, 14 and 19) for pivotal movement of the antenna member (1) about said axes (A, B, C), one or more electronic units (21, 22) for sensing and controlling the pivotal movements of the antenna member (1) and for the transfer of signals between the antenna member and a satellite, a unit (5) for, inter alia, transforming the signals from the satellite, a unit (23) for amplifying the signals from the satellite, a unit (30) for transferring the signals from the satellite from said signal transformer unit (5) to said signal amplifier unit (23), and a gyroscope unit (24), wherein the members (1, 6, 7, 8 and 9) forming part of the antenna are constructed such that more than 50% of the total mass of the antenna is concentrated to the antenna member (1) and/or to the frame member (6) in direct connection with the antenna member.

16. The antenna according to claim 15, wherein the members (1, 6, 7, 8, 9) forming part of the antenna are constructed such that more than 50% of the total mass of the antenna is concentrated to the antenna member (1) and/or to a first mounting member (7) of the frame member (6) located on the rear side of the antenna member.

* * * * *